US010661134B2

(12) United States Patent
Martell et al.

(10) Patent No.: US 10,661,134 B2
(45) Date of Patent: May 26, 2020

(54) SELF-ADJUSTING CARRYING STRAP SYSTEM FOR A GOLF BAG

(71) Applicant: KARSTEN MANUFACTURING CORPORATION, Phoenix, AZ (US)

(72) Inventors: James Martell, Phoenix, AZ (US); John Loudenslager, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 667 days.

(21) Appl. No.: 15/040,775

(22) Filed: Feb. 10, 2016

(65) Prior Publication Data

US 2016/0228752 A1 Aug. 11, 2016

Related U.S. Application Data

(60) Provisional application No. 62/115,038, filed on Feb. 11, 2015.

(51) Int. Cl.
*A45F 3/04* (2006.01)
*A63B 55/00* (2015.01)

(52) U.S. Cl.
CPC ..... *A63B 55/408* (2015.10); *A45F 3/047* (2013.01)

(58) Field of Classification Search
CPC ..... A63B 55/408; A45F 3/047
(Continued)

(56) References Cited

U.S. PATENT DOCUMENTS 425,173 A 4/1890 Gutmann
687,919 A 12/1901 Fairbrother, Jr.
(Continued)

FOREIGN PATENT DOCUMENTS

EP 0650677 5/1995
WO WO-03063970 A1 * 8/2003 ..... A45F 3/14
WO WO2005030001 4/2005

*Primary Examiner* — Justin M Larson
*Assistant Examiner* — Lester L Vanterpool

(57) ABSTRACT

Embodiments of a strap system for a golf bag are described herein. Various embodiments of the strap system for a golf bag comprise a first strap including a first end and a second end, each of the first and the second ends of the first strap configured to be coupled to the bag, a second strap including a first end and second end, each of the first and the second ends of the second strap configured to be coupled to the bag, a pad including a first portion including a first channel and a first clasp, the first strap extending through the first channel, the first clasp configured to receive the first strap and including a first position in which the first strap is immovable relative to the first portion and a second position in which the second strap is movable relative to the first portion, a second portion including a second channel and a second clasp, the second strap extending through the second channel, the second clasp configured to receive the second strap and including a first position in which the second strap is immovable relative to the second portion and a second position in which the second strap is movable relative to the second portion, and an elastic member coupled between the first portion of the pad and the second portion of the pad, wherein the first portion is coupled to the second portion and configured to maintain an orientation of the first strap relative to the second strap for ease of locating the first and the second straps prior to lifting and wearing the bag. Other examples and related methods are also disclosed herein.

15 Claims, 7 Drawing Sheets

(58) Field of Classification Search
USPC ..... 224/259, 642, 643, 264, 647, 651
See application file for complete search history.

(56) References Cited

U.S. PATENT DOCUMENTS 1,288,170 A 12/1918 Pick
1,501,066 A 7/1924 Rutherford
1,697,363 A 1/1929 Losey
2,676,737 A * 4/1954 Zirbel ..... A63B 55/408 224/264
2,835,010 A 5/1958 Bayon
3,739,961 A 6/1973 Soukeras
4,236,755 A 12/1980 Pollitt
4,757,927 A 7/1988 Rutty
4,764,962 A 8/1988 Ekman et al.
5,016,797 A 5/1991 Rowledge
5,038,984 A * 8/1991 Izzo ..... A45C 13/30 206/315.3
5,042,703 A 8/1991 Izzo
5,042,704 A * 8/1991 Izzo ..... A45C 13/30 224/643
5,421,614 A 6/1995 Zheng
5,490,620 A 2/1996 Bergqvist
5,593,077 A * 1/1997 Izzo ..... A63B 55/00 224/627
D411,039 S * 6/1999 Reimers ..... 224/645
D411,666 S * 6/1999 Reimers ..... D3/327
D413,019 S * 8/1999 Reimers ..... D3/255
5,954,255 A * 9/1999 Beebe ..... A63B 55/00 224/645
6,006,974 A * 12/1999 Varney ..... A45C 13/30 224/259
6,131,783 A * 10/2000 Maeng ..... A63B 55/408 206/315.3
6,152,342 A * 11/2000 Suk ..... A63B 55/408 224/259
6,152,343 A * 11/2000 Shin ..... A45F 3/14 224/259
6,180,060 B1 * 1/2001 Green ..... G01N 1/2226 366/108
6,305,535 B1 * 10/2001 Fair ..... A45C 13/26 206/315.3
6,460,747 B1 * 10/2002 Tuerschmann ..... A45F 3/14 206/315.3
6,530,129 B1 * 3/2003 Cheng ..... A45F 3/14 24/200
7,131,534 B2 * 11/2006 Enes ..... A45F 3/14 206/315.3
7,318,542 B2 1/2008 Godshaw et al.
7,387,226 B2 * 6/2008 Porter ..... A45F 3/02 206/315.3
7,857,181 B2 12/2010 Sacks
9,089,188 B2 * 7/2015 Wear ..... A45C 13/30
9,907,388 B2 * 3/2018 Herron ..... A45C 13/30
2002/0088836 A1 * 7/2002 Batten ..... A45F 3/047 224/645
2005/0087577 A1 * 4/2005 Thompson ..... A44B 11/14 224/641
2007/0278264 A1 12/2007 Chesal et al.
2010/0170065 A1 7/2010 Paik
2012/0241341 A1 * 9/2012 Harris ..... A45C 13/30 206/315.3
2012/0267410 A1 * 10/2012 Loudenslager ..... A63B 55/00 224/627

* cited by examiner

SELF-ADJUSTING CARRYING STRAP SYSTEM FOR A GOLF BAG

BACKGROUND

Golf bags of various forms include straps for carrying purposes. However, many golf bags can be difficult to carry with current strap designs due to golf bag size and shape, weight distribution, and/or strap positioning and fit. Accordingly, there is a need in the art for a strap system for a golf bag allowing ease in adjustment, and improved fit and carrying ability.

SUMMARY OF THE INVENTION

The present disclosure relates to golf bags. In particular, the present disclosure is related to a carrying strap system for a golf bag.

Figure 1:
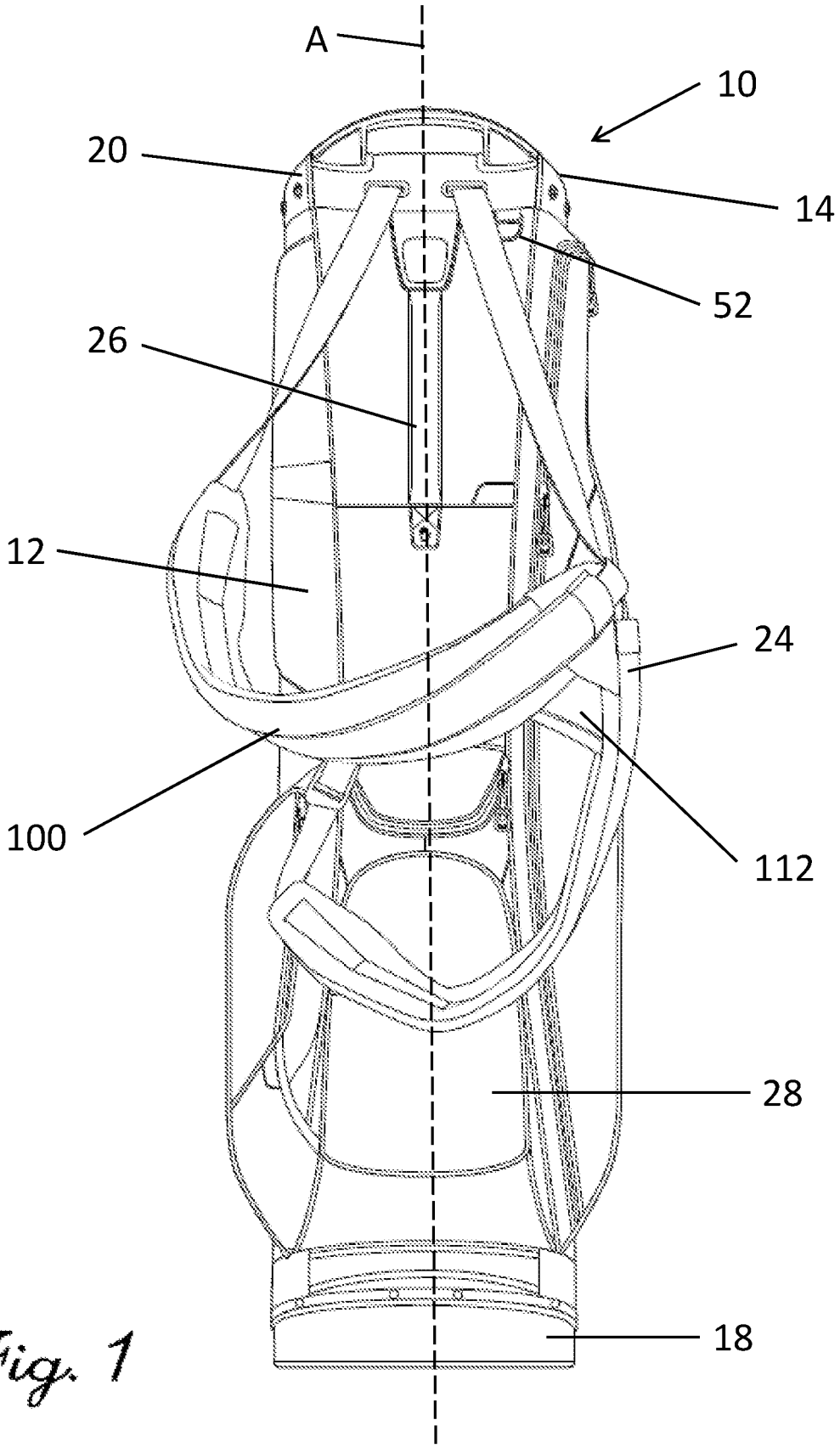
FIG. 1 is a first side view of a golf bag with a strap system.
Figure 2:
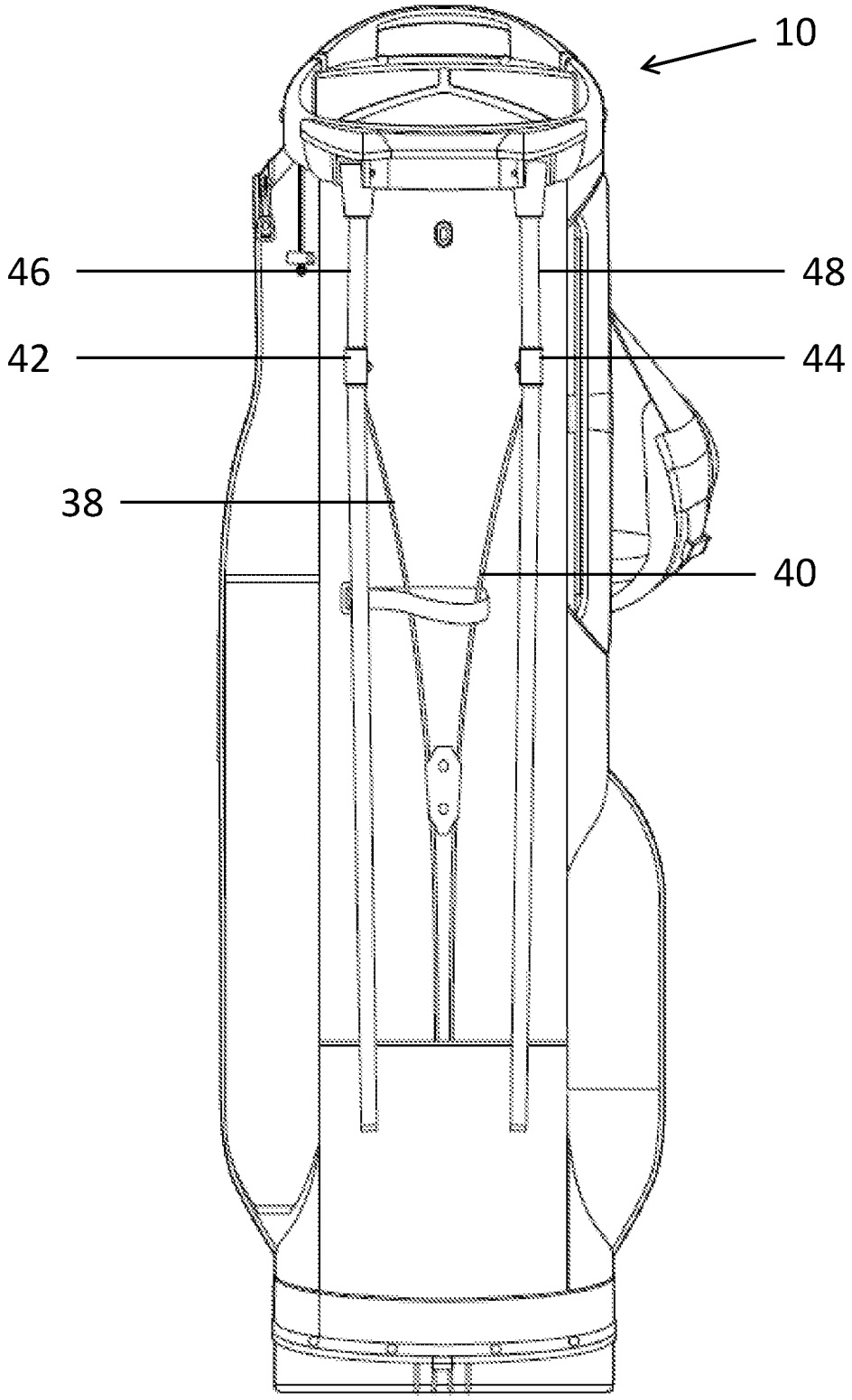
FIG. 2 is another side view of the golf bag of FIG. 1.
Figure 3:
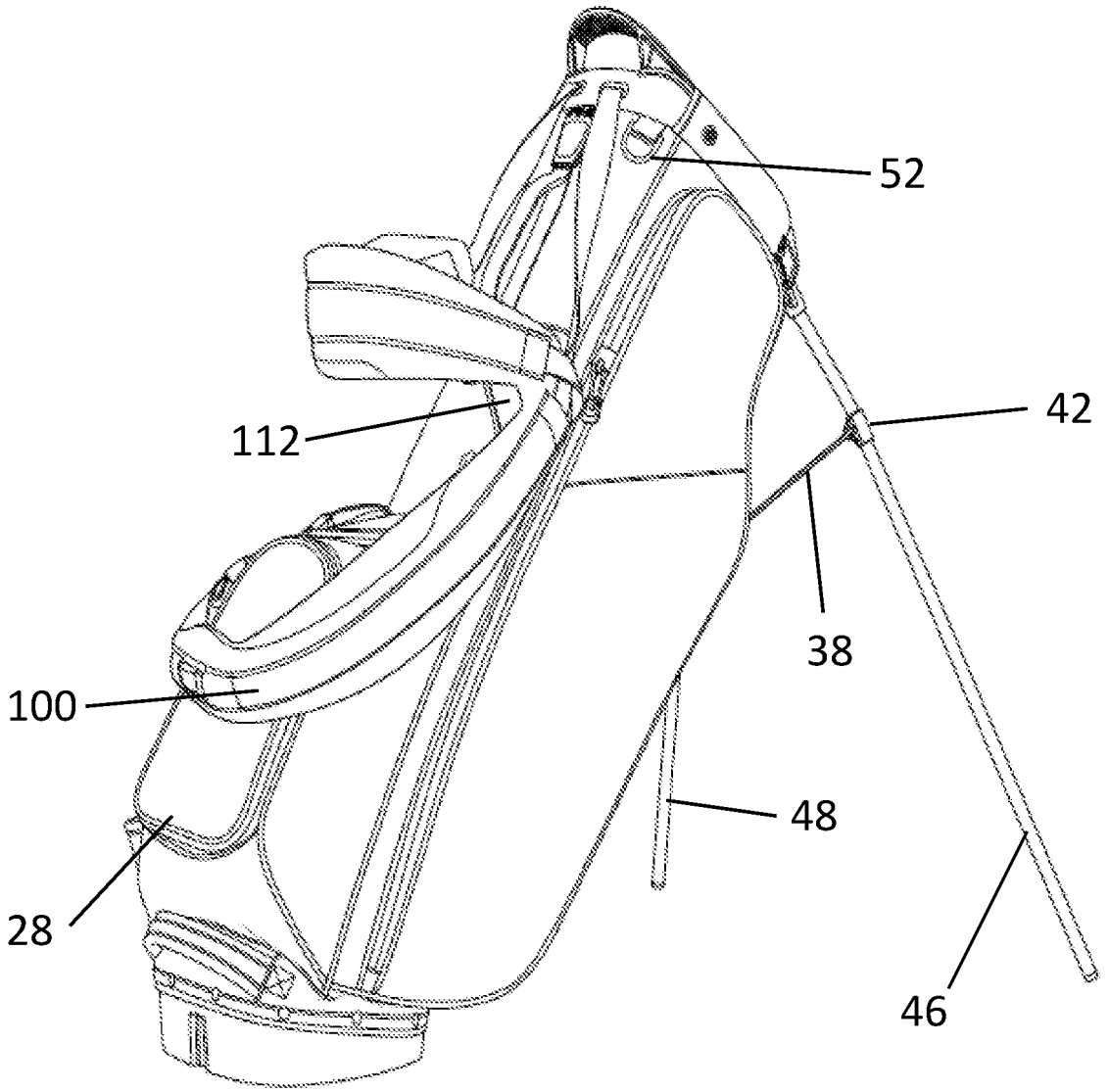
FIG. 3 is a perspective view of the golf bag of FIG. 1.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-4 illustrate a golf bag 10 including a body 12 that may include a housing 13 extending between an open end, top portion 14 and a closed, bottom portion 18 that is opposite the top portion 14. As illustrated in the figures, the body 12 is generally tubular-shaped, however other shapes are also suitable. A longitudinal axis A is defined between the top portion 14 and the bottom portion 18. The housing 13 may be formed of nylon or other lightweight fabric and is adapted to receive one or more golf clubs. A ring-shaped member such as a throat 20 is stitched or otherwise mounted to the top portion 14 of the body 12. The throat 20 includes a plurality of dividers (not shown) that segregate golf clubs with the golf clubs being inserted into and removed from the bag 10 through the throat 20. The bottom portion 18 may be rigid and similarly mounted to the bottom end of the body 12. Both the bottom portion 18 and the throat 20 may be molded or otherwise formed of a suitable synthetic resin in a manner well known in the art.

The golf bag 10 may also include various other features normally associated with golf bags such as a strap system 24, one or more handles 26 and at least one accessory pocket 28. The golf bag 10 also includes an attachment mechanism 52 coupled to the body 12 and positioned near the throat 20. A generally rigid frame (not shown) interconnects the throat 20 and the bottom portion 18 to keep the throat 20 and the bottom portion 18 in a spaced-apart relationship. The frame may be made of wood, fiberglass or other suitable rigid lightweight material. A lower end of the frame may be attached by a hinge to the bottom portion 18 by means of a length of fabric or other flexible material forming a fabric hinge which permits the bottom portion 18 to pivot relative to the frame. As can be determined from the foregoing, the side of the body 12 diametrically opposite the frame may be partially collapsible because the frame extends along only one side of the golf bag 10. Therefore, when placed upright resting on the bottom portion 18, the golf bag 10 may collapse toward this collapsible side.

The golf bag 10 further includes an automatically extensible stand with a U-shaped actuator rod (not shown), the lower end of which is attached to a bearing (not shown) formed in the bottom portion 18. The actuator rod has two upward extending arms 38, 40. The upper ends of the arms 38, 40 are pivotally attached to collars 42, 44, respectively. The collars 42, 44 are mounted on legs 46, 48 which are pivotally attached to at least one hinge or bearing on the throat 20.

Figure 4:
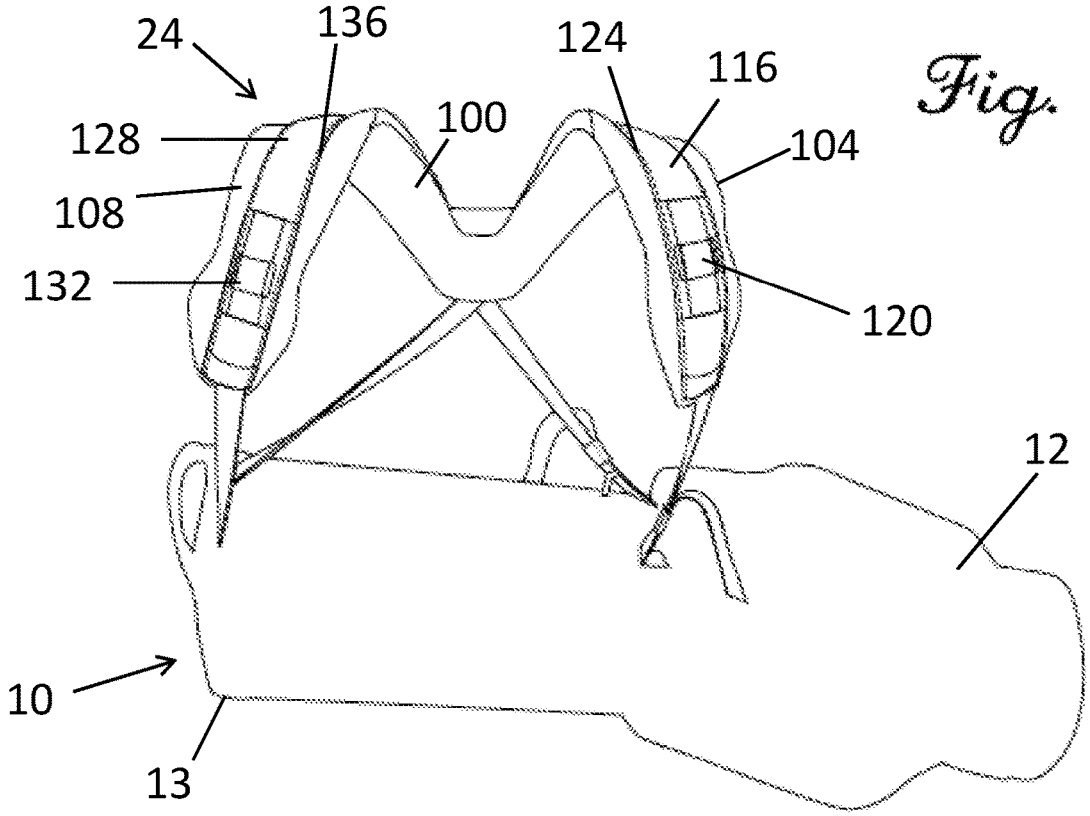
FIG. 4 is another side view of the golf bag of FIG. 1.
Figure 5:
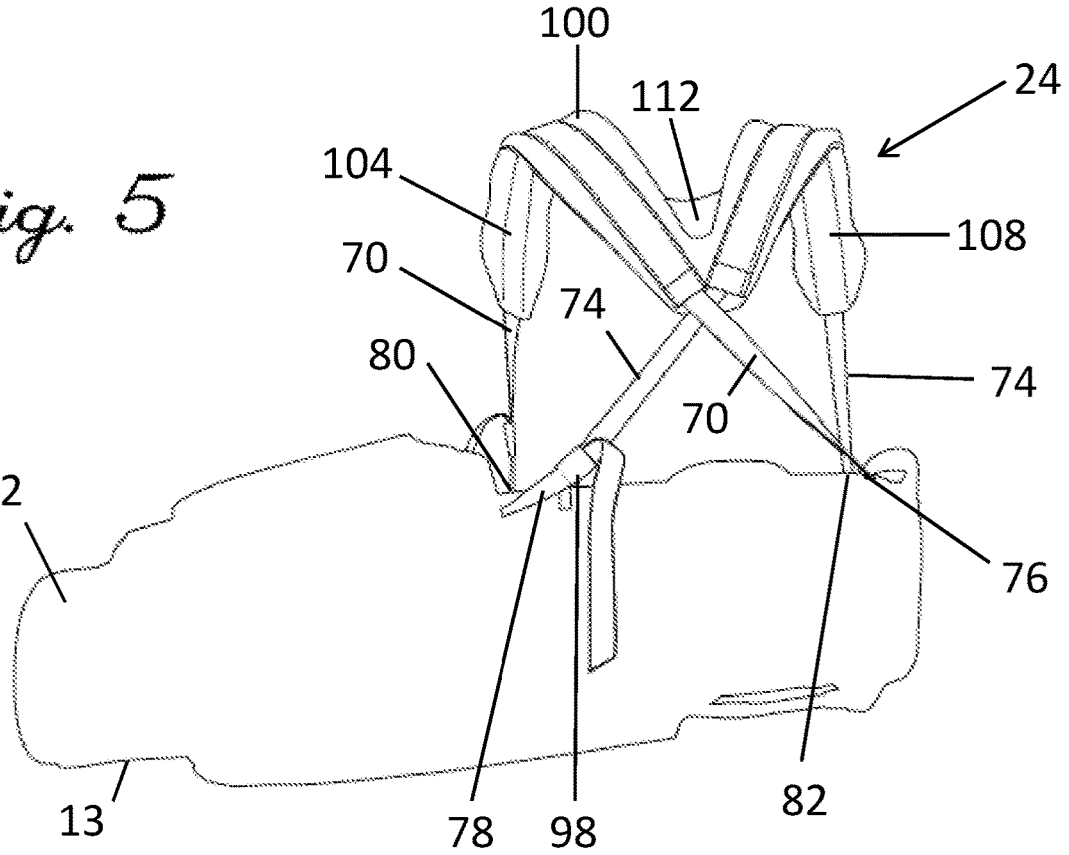
FIG. 5 is another side view of the golf bag of FIG. 1.
Figure 6:
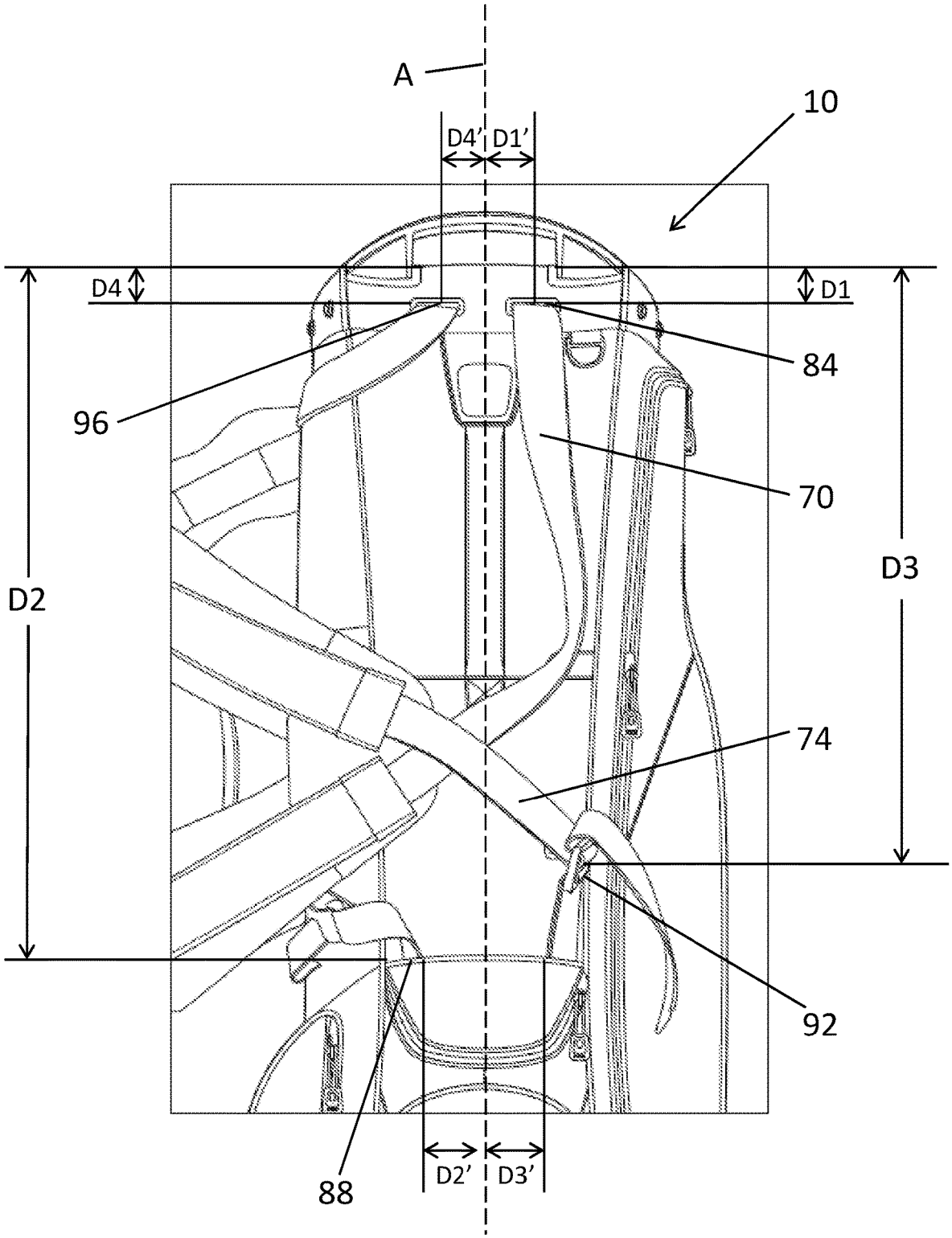
FIG. 6 is an enlarged view of the golf bag of FIG. 1.

With respect to FIGS. 4-6, the strap system 24 is connected to the body 12. The strap system 24 includes a first strap 70 and a second strap 74. The first strap 70 includes a first end 76 and a second end 80. The second strap 74 includes a first end 78 and a second end 82. The first end 76 of the first strap 70 is attached to the body 12 at a first location 84 adjacent the top portion 14, and the second end 80 of the first strap 70 is attached to the body 12 at a second location 88 that is spaced apart from the open end 14. The first end 78 of the second strap 74 is attached to the body 12 at a third location 92 that is spaced apart from the top portion 14, and the second end 82 of the second strap 74 is attached to the body 12 at a fourth location 96 adjacent the top portion 14. The first strap 70 and the second strap 74 each include an adjustment bracket 98. As illustrated, the first location 84 of the first end 76 of the first strap 70 is spaced apart from the open end of the bag 10 by a first distance D1, and the second location 88 of the second end 80 of the first strap 70 is spaced apart from the open end of the bag 10 by a second distance D2. Moreover, the third location 92 of the first end 78 of the second strap 74 is spaced apart from the open end of the bag 10 by a third distance D3, and the fourth location 96 of the second end 82 of the second strap 74 is spaced apart from the open end of the bag 10 by a fourth distance D4. In the illustrated embodiment, the first distance D1 and the fourth distance D4 are the same, while the second distance D2 and the third distance D3 are different. In the illustrated embodiment, the second distance D2 is greater than the third distance D3 and the first distance D1 and the fourth distance D4 are less than either of the second distance D2 or the third distance D3. The relative distances of the attachment points 84, 88, 92, 96 relative to the top portion 14 of the golf bag 10 causes the straps 70, 74 to be staggered relative to the body 12. In additional or alternative embodiments, the first distance D1 and the fourth distance D4 may differ from one another and/or the second distance D2 may be greater than or the same as the third distance D3.

As illustrated in FIG. 6, the first location 84 is spaced from the longitudinal axis A by a distance D1', and the fourth location 96 is spaced from the longitudinal axis A by a distance D4'. Similarly, the second location 88 is spaced from the longitudinal axis A by a second distance D2', and the third location 92 is spaced from the longitudinal axis A by a third distance D3'. In the illustrated embodiment, the first and the fourth distances D1', D4' are the same, and the second and the third distances D2', D3' are also the same. Also, the second and the third distances D2', D3' are greater than the first and the fourth distances D1', D4'. In additional or alternative embodiments, however, the first and the fourth distances D1', D4' may be different and/or greater or smaller than that illustrated herein. Similarly, the second and the third distances D3', D4' may be different and/or greater or smaller than that illustrated herein.

Further with respect to FIGS. 4-5, the shoulder strap system 24 further includes a pad 100. The pad 100 includes a first portion 104 and a second portion 108. In the illustrated embodiment, the first portion 104 is coupled to the second portion 108 to define a V-shape although in other embodiments the shape of the pad 100 may be any suitable shape (e.g., elliptical, triangular, W-shaped, etc.). An elastic or flexible member 112 extends between the first portion 104 and the second portion 108 of the pad 100. In the illustrated embodiment, the elastic member 112 is generally trapezoidal but may be other shapes in other embodiments (e.g., triangular, ovular, circular, rectangular, etc.). Similarly, the elastic member 112 may be any suitable size (e.g., larger or smaller) than that illustrated herein.

Figure 7:
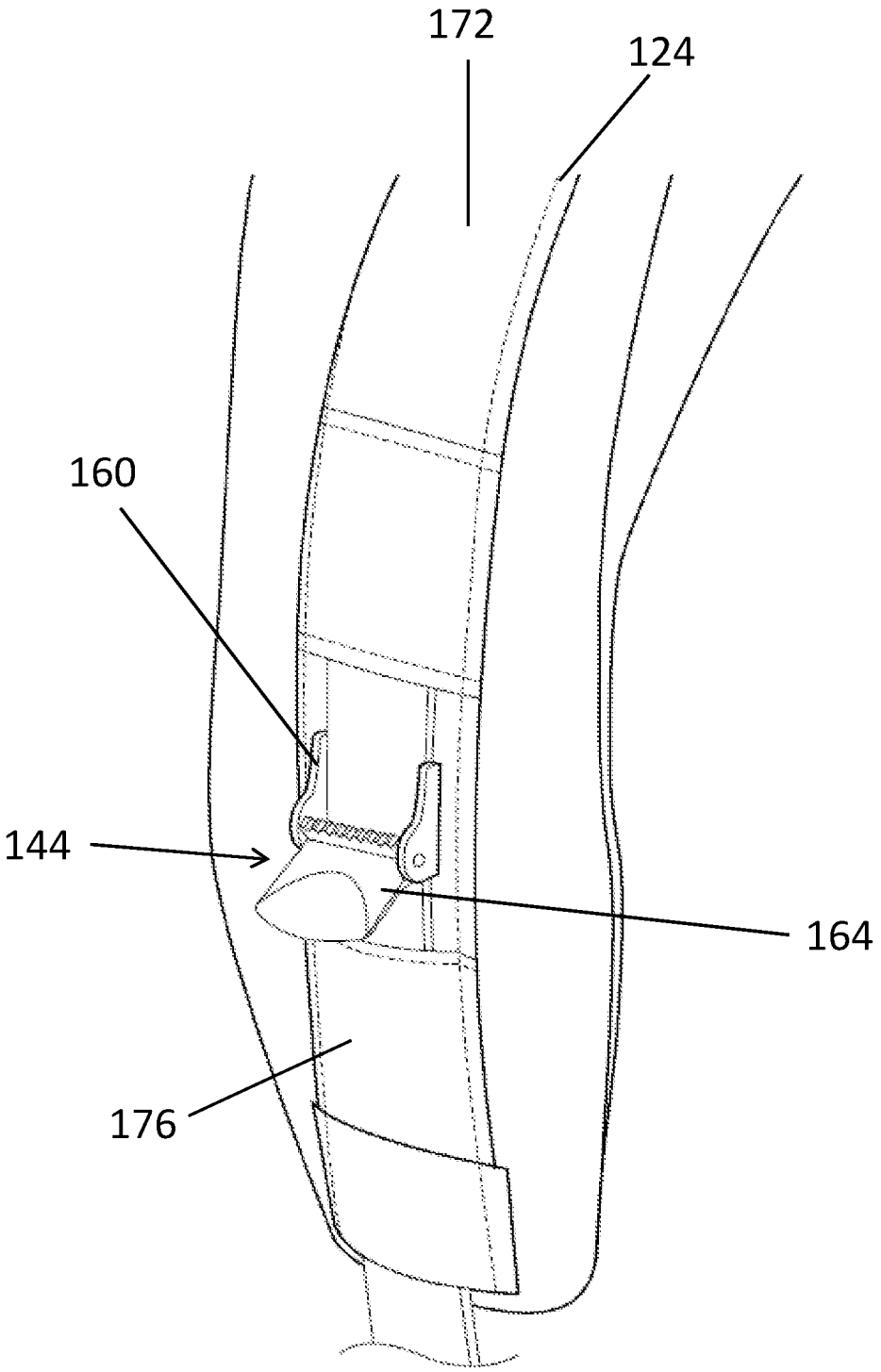
FIG. 7 is an enlarged view of a strap in a first position.
Figure 8:
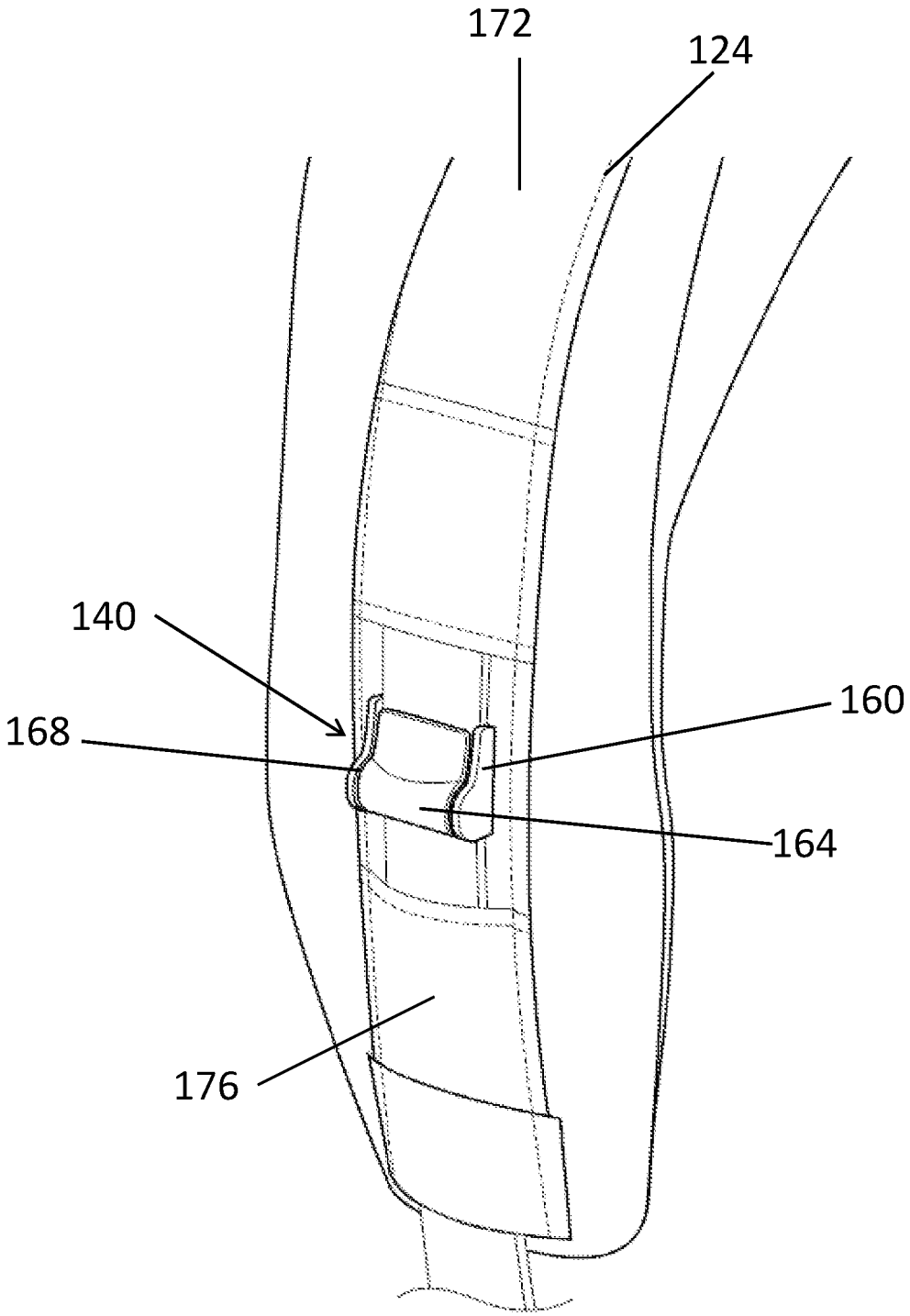
FIG. 8 is an enlarged view of a strap in a second position.

The first portion 104 includes a first channel 116, a first clasp 120, and a first reinforcement portion 124. The second portion 108 includes a second channel 128, a second clasp 132, and a second reinforcement portion 136. In the illustrated embodiment shown in FIGS. 7-8, the first clasp 120 includes a first, locked position 140 and a second, unlocked position 144, and the second clasp 132 includes a first, locked position 140 and a second, unlocked position 144. Further each of the first and the second clasps 120, 132 include a body 160 that is coupled to a surface of the pad 100 and a lock 164 that is coupled to and movable (i.e., pivotable) relative to the body 160. The lock 164 includes a cam surface 168 that is movable to achieve the locked or unlocked position 140, 144. As illustrated herein, each of the first channel 116 and the second channel 128 includes a first section 172 and a second section 176 that are spaced apart from one another by a gap (FIGS. 7-8). The second section 176 is smaller than the first section 172 in the illustrated embodiment, but in other embodiments, the first section 172 and the second section 176 may be equal in size or the first section 172 may be smaller than the second section 176. Also, in the illustrated embodiment, the first clasp 120 and the second clasp 132 are positioned within the gap of the respective portion 104, 108. In other embodiments, the first channel 116 and the second channel 128 may be continuous and the respective clasps 120, 132 positioned on either side thereof.

To assemble, the second end 80 of the first strap 70 is coupled to the second location 88 on the body 12 of the bag 10 and the first end 76 of the first strap 70 is guided through the first channel 116 of the first portion 104 of the pad 100. The first strap 70 is also guided between the body 160 and the lock164 of the first clasp 120 on the first portion 104 of the pad 100. The first end 76 of the first strap 70 is coupled to the first location 84 on the body 12 of the bag 10. Similarly, the first end 78 of the second strap 74 is coupled to the third location 92 on the body 12 of the bag 10 and the second end 82 of the second strap 74 is guided through the second channel 128 of the second portion 108 of the pad 100. The second strap 74 is also guided between the body 160 and the lock 164 of the second clasp 132 on the second portion 108 of the pad 100. The second end 82 of the second strap 74 is coupled to the fourth location 96 on the body 12 of the bag 10. In the illustrated embodiment, each of the first and the second reinforcement members 124, 136 is also positioned at least partially with the first and the second channels 116, 128, respectively, of each of the first and the second portions 104, 108.

In use, the user wears the strap system 24 to carry the golf bag 10. The pad 100 relieves pressure in the straps 70, 74 due to the weight of the bag 10 contents when the bag 10 is carried. Further, because the first and the second portions 104, 108 of the pad 100 are coupled, the orientation of the first strap 70 relative to the second strap 74 is maintained when not in use. The elastic member 112 provides additional structural reinforcement to the pad 100 where the first and the second portions 104, 108 are coupled to maintain the orientation of the first portion 104 relative to the second portion 108 of the pad 100 while also being able to stretch or deform such that the first and the second portions 104, 108 of the pad 100 can be configured to fit any user.

Also, the strap system 24 is adjustable while in use. In particular, the lock 164 of each of the first and the second clasps 120, 132 are movable to achieve the locked and the unlocked positions 140, 144 to restrict or allow movement of the first and the second straps 70, 74 within the channels 116, 128, respectively, of the first and the second portions 104, 108. For example, when the lock 164 of each of the first or the second clasps 120, 132 is in the locked position 140, the cam surface 168 engages with the respective first or second strap 70, 74. Therefore, the cam surface 168 of each of the first and the second clasp 120, 132 imparts a first compression force on the respective first or second strap 70,74 such that the first or the second strap 70, 74 is unable to move within the respective first or second channel 116, 128. In other words, the first or the second strap 70, 74 is immovable relative to the respective first or second portion 104, 108 when the respective first or second clasp 120, 132 is in the locked position 140. To adjust the first and/or the second strap 70, 74 the user moves (i.e., pivots) one or both of the lock 164 of the respective first or the second clasp 120, 132 into the unlocked position 144. When the lock 164 are in the unlocked position 144, the respective cam surface 168 is not engaged with (e.g., spaced apart from) the respective first or second strap 70, 74. Therefore, the cam surface 168 of each of the first and the second clasp 120, 132 imparts a second compression force on the respective first or second strap 70, 74 such that the respective straps 70, 74 are able to move within to the respective channels 116, 128. In other words, the first or the second strap 70, 74 is movable relative to the respective first or second portion 104, 108 when the respective first or second clasp 120, 132 is in the unlocked position 144. This is because the second force is less than the first force.

The adjustability of the strap system 24 permits adjustment of the strap system 24 during use and while the strap system 24 is worn by the user. For example, when either or both of the lock 164 is in the unlocked position 144, the user can move or manipulate the bag 10 to adjust the first and/or second strap 70, 74 relative to the pad 100. During adjustment, the location on the pad 100 where the first and second straps 70, 74 move relative to one another acts as a pivot point. The pivot point aids in balance of the body 12 during adjustment. Balance of the golf bag 10 is also achieved in part because the straps 70, 74 are staggered relative to the body 12. Also, such staggering of the attachment points 84, 88, 92, 96 of the straps 70, 74 allows the open end 14 of the golf bag 10 to remain generally upright when the strap system 24 is worn and during adjustment of the strap system 24. When the strap system 24 is worn, a gap exists between the user and the bag 10 allowing space for movement needed to adjust the bag 10 position. The straps 70, 74 may also be tightened or loosened using the adjustment brackets 98 while the strap system 24 is worn or not worn.

When not in use, such as when the bag 10 is on the ground or supported by the legs 38, 40, the pad 100 restricts movement of the first and the second portions 104, 108 relative to one another thereby preventing the straps 70, 74 from becoming tangled. Because the first and the second portions 104, 108 are coupled, movement of the first and the second straps 70, 74 is restricted to generally translational movement along the length of the respective first and second channels 116, 128. Further, the V-shape of the pad 100 allows for ease in locating the straps 70, 74 to lift and wear the bag 10. All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1: A strap system for a golf bag, the strap system comprising a first strap including a first end and a second end, each of the first and the second ends of the first strap configured to be coupled to the bag, a second strap including a first end and second end, each of the first and the second ends of the second strap configured to be coupled to the bag, a pad including a first portion including a first channel and a first clasp, the first strap extending through the first channel, the first clasp configured to receive the first strap and including a first position in which the first strap is immovable relative to the first portion and a second position in which the second strap is movable relative to the first portion, a second portion including a second channel and a second clasp, the second strap extending through the second channel, the second clasp configured to receive the second strap and including a first position in which the second strap is immovable relative to the second portion and a second position in which the second strap is movable relative to the second portion, an elastic member coupled between the first portion of the pad and the second portion of the pad, wherein the first portion is coupled to the second portion and configured to maintain an orientation of the first strap relative to the second strap for ease of locating the first and the second straps prior to lifting and wearing the bag.

Clause 2: The strap system of clause 1, wherein each of the first and the second channels includes a first section and a second section, the first section and second section being spaced apart by a gap.

Clause 3: The strap system of clause 2, wherein the first clasp is positioned in the gap of the first channel and the second clasp is positioned in the gap of the second channel.

Clause 4: The strap system of clause 1, wherein each of the first or the second clasps includes a body that is coupled to a surface of the pad and a lock that is coupled to and movable relative to the body of the clasp, the lock of each of the first and the second clasps including a cam surface.

Clause 5: The strap system of clause 4, wherein when each of the first and the second clasps is in the first position, the cam surface of the lock imparts a first compression force on the first strap and the second strap, respectively.

Clause 6: The strap system of clause 5, wherein when each of the first and the second clasps is in the second position, the cam surface of the lock imparts a second compression force on the first strap and the second strap, respectively, the second compression force being less than the first compression force.

Clause 7: The strap system of clause 1, wherein the first portion is coupled to the second portion to define a V-shape.

Clause 8: A golf bag comprising a body including an open end and a closed end, the body having a longitudinal axis, a housing extending between the open end and the closed end, a strap system coupled to the body, the strap system including a first strap including a first end and a second end, each of the first and the second ends of the first strap configured to be coupled to the bag, a second strap including a first end and second end, each of the first and the second ends of the second strap configured to be coupled to the bag, a pad including a first portion including a first channel and a first clasp, the first strap extending through the first channel, the first clasp configured to receive the first strap and including a first position in which the first strap is immovable relative to the first portion and a second position in which the second strap is movable relative to the first portion, a second portion including a second channel and a second clasp, the second strap extending through the second channel, the second clasp configured to receive the second strap and including a first position in which the second strap is immovable relative to the second portion and a second position in which the second strap is movable relative to the second portion, an elastic member coupled between the first portion of the pad and the second portion of the pad, wherein the first portion is coupled to the second portion and configured to maintain an orientation of the first strap relative to the second strap for ease of locating the first and the second straps prior to lifting and wearing the bag.

Clause 9: The golf bag of clause 8, wherein each of the first and the second channels includes a first section and a second section, the first section and second section being spaced apart by a gap.

Clause 10: The golf bag of clause 9, wherein the first clasp is positioned in the gap of the first channel and the second clasp is positioned in the gap of the second channel.

Clause 11: The golf bag of clause 8, wherein each of the first or the second clasps includes a body that is coupled to a surface of the pad and a lock that is coupled to and movable relative to the body of the clasp, the lock of each of the first and the second clasps including a cam surface.

Clause 12: The golf bag of clause 11, wherein when each of the first and the second clasps is in the first position, the cam surface of the lock imparts a first compression force on the first strap and the second strap, respectively.

Clause 13: The golf bag of clause 12, wherein when each of the first and the second clasps is in the second position, the cam surface of the lock imparts a second compression force on the first strap and the second strap, respectively, the second compression force being less than the first compression force.

Clause 14: The golf bag of clause 8, wherein the first portion is coupled to the second portion to define a V-shape.

Clause 15: The golf bag of clause 8, wherein the first end of the first strap is attached to the body at a first location that is adjacent to the open end of the body, the first location and the open end being spaced apart by a first distance, and the second end of the first strap is attached to the body at a second location that is spaced apart from the open end of the body, the second location and the open end being spaced apart by a second distance.

Clause 16: The golf bag of clause 15, wherein the first end of the second strap is attached to the body at a third location that is spaced apart from the open end of the body, the third location and the open end being spaced apart by a third distance, and the second end of the second strap is attached to the body at a fourth location adjacent to the open end of the body, the fourth location and the open end being spaced apart by a fourth distance.

Clause 17: The golf bag of clause 16, wherein the first distance is the same as the fourth distance.

Clause 18: The golf bag of clause 16, wherein the second distance is different than the third distance.

Clause 19: The golf bag of clause 16, wherein the first distance and the fourth distance are less than both the second distance and the third distance.

Clause 20: A method of assembling a strap system for a golf bag, the method comprising providing a first strap including a first end and a second end, each of the first and the second ends of the first strap configured to be coupled to the bag, providing a second strap including a first end and second end, each of the first and the second ends of the second strap configured to be coupled to the bag, providing a pad including a first portion coupled to a second portion and an elastic member coupled between the first portion and the second portion, the pad configured to maintain an orientation of the first strap relative to the second strap for ease of locating the first and the second straps prior to lifting and wearing the bag, coupling the second end of the first strap to the bag, guiding the first end of the first strap through a first channel and a first clasp of the first portion of the pad, coupling the first end of the first strap to the bag, coupling the second end of the second strap to the bag, guiding the second end of the second strap through a second channel and a second clasp of the second portion of the pad, and coupling the second end of the first strap to the bag.

Various features and advantages of the disclosure are set forth in the following claims.

What is claimed is:

1. A strap system for a golf bag, the strap system comprising:

a first strap including a first end and a second end, each of the first end and the second end of the first strap configured to be coupled to a golf bag body; wherein the first strap is one integral unit from the first end to the second end;

wherein the first strap first end is attached to a first location adjacent to a golf bag body top portion, and the first strap second end is attached to the golf bag body at a second location spaced apart from an open end of the golf bag;

a second strap including a first end and second end, each of the first end and the second end of the second strap configured to be coupled to a golf bag body; wherein the second strap is one integral unit from the first end to the second end; and wherein the second strap first end is attached to the golf bag body at a third location spaced apart from the open end of the golf bag, and the second strap second end is attached to the golf bag body at a fourth location adjacent to the golf bag body top portion;

wherein the first location is spaced apart from the open end of the golf bag by a first distance, the second location is spaced apart from the open end of the golf bag by a second distance, the third location is spaced apart from the open end of the golf bag by a third distance, and the fourth location is spaced apart from the open end of the golf bag by a fourth distance;

wherein the first distance and the fourth distance are the same, and the second distance and the third distance are different;

wherein the second distance is greater than the third distance; and wherein the first distance and the fourth distance are less than either of the second distance or the third distance;

a pad including:

a first portion including a first channel and a first clasp, the first strap extending through the first channel and the first clasp, the first clasp configured to receive the first strap and including a first position in which the first strap is immovable relative to the entire pad and a second position in which the first strap is movable relative to the entire pad;

a second portion including a second channel and a second clasp, the second strap extending through the second channel and the second clasp, the second clasp configured to receive the second strap and including a first position in which the second strap is immovable relative to the entire pad and a second position in which the second strap is movable relative to the entire pad;

an elastic member coupled between the first portion of the pad and the second portion of the pad, wherein the first portion is coupled to the second portion and configured to maintain an orientation of the first strap relative to the second strap for ease of locating the first and the second straps prior to lifting and wearing the bag.

2. The strap system of claim 1, wherein each of the first and the second channels includes a first section and a second section, the first section and second section being spaced apart by a gap;

wherein the first clasp is positioned in the gap of the first channel and the second clasp is positioned in the gap of the second channel.

3. The strap system of claim 1, wherein each of the first or the second clasps includes a body that is coupled to a surface of the pad and a lock that is coupled to and movable relative to the body of the clasp, the lock of each of the first and the second clasps including a cam surface.

4. The strap system of claim 3, wherein when each of the first and the second clasps is in the first position, the cam surface of the lock imparts a first compression force on the first strap and the second strap, respectively.

5. The strap system of claim 4, wherein when each of the first and the second clasps is in the second position, the cam surface of the lock imparts a second compression force on the first strap and the second strap, respectively, the second compression force being less than the first compression force.

6. The strap system of claim 1, wherein the first portion is coupled to the second portion to define a V-shape.

7. The strap system of claim 1, further comprising:

a first adjustment bracket engaged with the first strap, and a second adjustment bracket engaged with the second strap, wherein the first adjustment bracket enables length adjustment of the first strap and the second adjustment bracket enables length adjustment of the second strap.

8. A golf bag comprising:

a body including an open end and a closed end, the body having a longitudinal axis;

a housing extending between the open end and the closed end;

a strap system coupled to the body, the strap system including:

a first strap including a first end and a second end, each of the first end and the second end of the first strap configured to be coupled to the golf bag body; wherein the first strap is one integral unit from the first end to the second end;

wherein the first strap first end is attached to a first location adjacent to a golf bag body top portion, and the first strap second end is attached to the golf bag body at a second location spaced apart from an open end of the golf bag;

a second strap including a first end and second end, each of the first end and the second end of the second strap configured to be coupled to the golf bag body; wherein the second strap is one integral unit from the first end to the second end; and wherein the second strap first end is attached to the golf bag body at a third location spaced apart from the open end of the golf bag, and the second strap second end is attached to the golf bag body at a fourth location adjacent to the golf bag body top portion;

wherein the first location is spaced apart from the open end of the golf bag by a first distance, the second location is spaced apart from the open end of the golf bag by a second distance, the third location is spaced apart from the open end of the golf bag by a third distance, and the fourth location is spaced apart from the open end of the golf bag by a fourth distance;

wherein the first distance and the fourth distance are the same, and the second distance and the third distance are different;

wherein the second distance is greater than the third distance; and wherein the first distance and the fourth distance are less than either of the second distance or the third distance; and a pad including:

a first portion including a first channel and a first clasp, the first strap extending through the first channel and the first clasp, the first clasp configured to receive the first strap and including a first position in which the first strap is immovable relative to the entire pad and a second position in which the second strap is movable relative to the entire pad;

a second portion including a second channel and a second clasp, the second strap extending through the second channel and the second clasp, the second clasp configured to receive the second strap and including a first position in which the second strap is immovable relative to the entire pad and a second position in which the second strap is movable relative to the entire pad;

an elastic member coupled between the first portion of the pad and the second portion of the pad, wherein the first portion is coupled to the second portion and configured to maintain an orientation of the first strap relative to the second strap for ease of locating the first and the second straps prior to lifting and wearing the bag.

9. The golf bag of claim 8, wherein each of the first and the second channels includes a first section and a second section, the first section and second section being spaced apart by a gap;

wherein the first clasp is positioned in the gap of the first channel and the second clasp is positioned in the gap of the second channel.

10. The golf bag of claim 8, wherein each of the first or the second clasps includes a body that is coupled to a surface of the pad and a lock that is coupled to and movable relative to the body of the clasp, the lock of each of the first and the second clasps including a cam surface.

11. The golf bag of claim 10, wherein when each of the first and the second clasps is in the first position, the cam surface of the lock imparts a first compression force on the first strap and the second strap, respectively.

12. The golf bag of claim 11, wherein when each of the first and the second clasps is in the second position, the cam surface of the lock imparts a second compression force on the first strap and the second strap, respectively, the second compression force being less than the first compression force.

13. The golf bag of claim 8, wherein the first portion is coupled to the second portion to define a V-shape.

14. The golf bag of claim 8, wherein the strap system further comprises:

a first adjustment bracket engaged with the first strap, and a second adjustment bracket engaged with the second strap, wherein the first adjustment bracket enables length adjustment of the first strap and the second adjustment bracket enables length adjustment of the second strap.

15. A method of assembling a strap system for a golf bag, the method comprising:

providing a first strap including a first end and a second end, each of the first and the second ends of the first strap configured to be coupled to the bag; wherein the first strap is one integral unit from the first end to the second end;

wherein the first strap first end is attached to a first location adjacent to a golf bag body top portion, and the first strap second end is attached to the golf bag body at a second location spaced apart from an open end of the golf bag;

providing a second strap including a first end and second end, each of the first and the second ends of the second strap configured to be coupled to the bag; wherein the second strap is one integral unit from the first end to the second end; and wherein the second strap first end is attached to the golf bag body at a third location spaced apart from the open end of the golf bag, and the second strap second end is attached to the golf bag body at a fourth location adjacent to the golf bag body top portion;

wherein the first location is spaced apart from the open end of the golf bag by a first distance, the second location is spaced apart from the open end of the golf bag by a second distance, the third location is spaced apart from the open end of the golf bag by a third distance, and the fourth location is spaced apart from the open end of the golf bag by a fourth distance;

wherein the first distance and the fourth distance are the same, and the second distance and the third distance are different;

wherein the second distance is greater than the third distance; and wherein the first distance and the fourth distance are less than either of the second distance or the third distance:

providing a pad including a first portion coupled to a second portion and an elastic member coupled between the first portion and the second portion, the pad configured to maintain an orientation of the first strap relative to the second strap for ease of locating the first and the second straps prior to lifting and wearing the bag;

coupling the second end of the first strap to the bag;

guiding the first end of the first strap through a first channel and a first clasp of the first portion of the pad; wherein the first strap is immovable relative to the entire pad when the first clasp is in a first position and is movable relative to the entire pad when the first clasp is in a second position;

coupling the first end of the first strap to the bag;

coupling the second end of the second strap to the bag;

guiding the first end of the second strap through a second channel and a second clasp of the second portion of the pad; wherein the second strap is immovable relative to the entire pad when the second clasp is in a first position and is movable relative to the entire pad when the second clasp is in a second position; and coupling the first end of the second strap to the bag.

* * * * *